US012760526B2

(12) United States Patent
Park

(10) Patent No.: US 12,760,526 B2
(45) Date of Patent: Oct. 13, 2026

(54) RETRACTABLE SUNSHADE FACILITY

(71) Applicant: Geon Hyeong Park, Seoul (KR)

(72) Inventor: Geon Hyeong Park, Seoul (KR)

( * ) Notice: Subject to any disclaimer, the term of this patent is extended or adjusted under 35 U.S.C. 154(b) by 0 days.

(21) Appl. No.: 19/147,380

(22) PCT Filed: Jan. 16, 2024

(86) PCT No.: PCT/KR2024/000785
§ 371 (c)(1),
(2) Date: Jul. 11, 2025

(87) PCT Pub. No.: WO2024/155073
PCT Pub. Date: Jul. 25, 2024

(65) Prior Publication Data

US 2026/0110178 A1 Apr. 23, 2026

(30) Foreign Application Priority Data

Jan. 16, 2023 (KR) ..... 10-2023-0005996

(51) Int. Cl.
*E04F 10/10* (2006.01)
*F25C 5/08* (2006.01)

(52) U.S. Cl.
CPC ..... *E04F 10/10* (2013.01); *F25C 5/08* (2013.01)

(58) Field of Classification Search
CPC .. E04F 10/08; E04F 10/10; E04B 7/16; E04B 7/163; E04B 7/166; F25C 5/08; A01G 9/22; A01G 9/222
See application file for complete search history.

(56) References Cited

U.S. PATENT DOCUMENTS 3,219,101 A * 11/1965 Prehn ..... E04F 10/10 160/206
3,651,852 A * 3/1972 Neri ..... E06B 9/302 160/172 R
5,550,349 A * 8/1996 Bomba ..... E04D 13/103 219/548
9,145,732 B2 * 9/2015 Frigerio ..... E04B 7/166
(Continued)

FOREIGN PATENT DOCUMENTS

KR 10-2068117 B1 1/2020
KR 10-2021-0015224 A 2/2021
(Continued)

OTHER PUBLICATIONS

International Search Report for PCT/KR2024/000785 mailed Apr. 16, 2024 from Korean Intellectual Property Office.

*Primary Examiner* — Johnnie A. Shablack
(74) *Attorney, Agent, or Firm* — Revolution IP, PLLC

(57) ABSTRACT

A retractable sunshade facility of the present invention comprises: a roof frame forming an open ceiling defined by a pair of transverse frames and a pair of lengthwise frames; a plurality of moving blades, each of which is rotatable with respect to the transverse frames and movable in the longitudinal direction of the transverse frames, and connected to each other by links and interlocked therewith; a retractable operating unit connected to at least one f the plurality of movable blades and movable in the longitudinal direction of the transverse frames; a motor that provides a rotational force; and an operating belt that is driven by the motor and moves the retractable operating unit.

2 Claims, 9 Drawing Sheets

(56) References Cited

U.S. PATENT DOCUMENTS

| | | | | |
|---|---|---|---|---|
| 10,094,122 | B1 * | 10/2018 | Akbulut | E04B 7/163 |
| 10,280,625 | B2 * | 5/2019 | Byszenski | E04F 10/10 |
| 10,560,050 | B2 * | 2/2020 | Raghunathan | H02S 20/30 |
| 11,015,349 | B2 * | 5/2021 | Byszenski | E04F 10/10 |
| 11,156,014 | B1 * | 10/2021 | He | E04F 10/02 |
| 11,168,481 | B2 * | 11/2021 | Rieber | E04B 1/0046 |
| 11,313,130 | B2 * | 4/2022 | Whytlaw | E04F 10/10 |
| 11,313,131 | B2 * | 4/2022 | Terenzi | E06B 9/0676 |
| 12,037,794 | B1 * | 7/2024 | Rayburn | E04B 7/163 |
| 12,173,510 | B2 * | 12/2024 | Ma | E04F 10/02 |
| 12,264,477 | B2 * | 4/2025 | Hong | E04F 10/10 |
| 12,305,403 | B2 * | 5/2025 | Marin Rodriguez | E04B 7/163 |
| 12,352,051 | B2 * | 7/2025 | Liang | E04F 10/10 |
| 12,428,848 | B2 * | 9/2025 | Brabant | E04F 10/10 |
| 12,486,670 | B1 * | 12/2025 | Lin | E04F 10/10 |
| 12,503,860 | B2 * | 12/2025 | Bontinck | E04F 10/10 |
| 12,546,115 | B2 * | 2/2026 | He | E04F 10/10 |
| 2009/0158673 | A1 * | 6/2009 | Friedman | E04B 7/14 52/173.1 |
| 2014/0130988 | A1 * | 5/2014 | Frigerio | E04B 7/166 160/161 |
| 2017/0138057 | A1 * | 5/2017 | Ventrella | E04F 10/10 |
| 2019/0145107 | A1 * | 5/2019 | Byszenski | E04F 10/10 160/62 |
| 2021/0332587 | A1 * | 10/2021 | Geriavenko | E04F 10/10 |
| 2022/0120088 | A1 * | 4/2022 | Byszenski | E04B 7/166 |
| 2024/0141650 | A1 * | 5/2024 | Abeel | E04F 10/10 |
| 2024/0384531 | A1 * | 11/2024 | Vanluchene | E04B 7/163 |
| 2024/0384537 | A1 * | 11/2024 | Fan | E04F 10/10 |
| 2025/0333964 | A1 * | 10/2025 | Shao | E04F 10/10 |

FOREIGN PATENT DOCUMENTS

| | | | | |
|---|---|---|---|---|
| KR | 10-2228418 | B1 | 3/2021 | |
| KR | 10-2022-0094840 | A | 7/2022 | |
| WO | WO-2021048773 | A1 * | 3/2021 | E04B 7/163 |

* cited by examiner

RETRACTABLE SUNSHADE FACILITY

TECHNICAL FIELD

The present invention relates to a retractable sunshade apparatus, and more particularly to retractable sunshade apparatus capable of automatically opening and closing a ceiling.

BACKGROUND ART

Generally, sunshade structures are used to block sunlight or prevent rain from entering, and are commonly utilized in pergolas that provide resting areas or storage spaces for items such as bicycles.

Korean Patent Registration No. 10-2068117 discloses a "louver system." The disclosed louver system comprises a plurality of louver slats arranged in parallel, each of which is configured to rotate between an open position at an angle of 90 degrees and a closed position.

However, such a related art has a drawback in that opening of the ceiling is achieved through the spacing between the louver slats, resulting in a reduced sense of openness even when the ceiling is fully open, and also causing the formation of shadows due to the louver slats.

DISCLOSURE

Technical Problem

Therefore, it is a first object of the present invention to provide a retractable sunshade apparatus in which blades, which constitute the ceiling, are automatically movable to one side to open the ceiling.

It is a second object of the present invention to provide a retractable sunshade apparatus configured to minimize shadows formed due to the blades during opening of the ceiling.

It is a third object of the present invention to provide a retractable sunshade apparatus including a drive mechanism configured to cause individual blades to be moved while being rotated during opening and closing of the ceiling.

It is a fourth object of the present invention to provide a retractable sunshade apparatus configured to allow stable rotation and movement of the blades without shaking.

Technical Solution

In accordance with an aspect of the present invention, the present invention provides a retractable sunshade apparatus including a roof frame comprising a pair of crosswise frames and a pair of lengthwise frames which define an open ceiling, a plurality of movable blades which are rotatable relative to the crosswise frames, are movable in a longitudinal direction of the pair of crosswise frames, and are interconnected so as to be moved in linkage via a link, an opening and closing drive unit connected to at least one of the plurality of movable blades and movable in the longitudinal direction of the crosswise frames, a motor configured to supply rotative force, a drive belt which is operated to move the opening and closing drive unit by the motor, a blade wheel coupled to one of rotating shafts of the movable blades, and a guide frame provided at at least one of the crosswise frames to form a rail configured to guide movement of the blade wheel.

The opening and closing drive unit includes a belt carrier connecting the rotating shaft to the drive belt, and a carrier wheel rotatably coupled to the belt carrier and movably disposed on the guide frame.

The guide frame may include a carrier wheel guide, which defines a space receiving the carrier wheel and an inner surface of which, defining the space, guides movement of the carrier wheel.

The carrier wheel guide may be constructed such that a portion of the inner surface, positioned above the carrier wheel, is maintained in a state of being in contact with the carrier wheel during movement of carrier wheel. The rail may be disposed under the blade wheel.

The carrier wheel may be spaced apart from a portion of the inner surface positioned under the carrier wheel.

The retractable sunshade apparatus may further include a rail cover surrounding an upper end of the rail, and the blade wheel may be in contact with the rail cover.

The retractable sunshade apparatus may further include a weather sensor configured to detect rainfall or snowfall, a heat generator disposed on the movable blades, and a controller configured to control activation of the heat generator according to a result of detection of the weather sensor.

In accordance with another aspect of the present invention, the present invention provides a retractable sunshade apparatus including a roof frame comprising a pair of crosswise frames and a pair of lengthwise frames which define an open ceiling, a plurality of movable blades which are connected to each other via a link and which are moved in a longitudinal direction of the pair of crosswise frames to close the ceiling, a rail extending in the longitudinal direction of the pair of crosswise frames, an opening and closing drive unit connected to one of the plurality of movable blades, a motor configured to supply rotative force, a drive belt that is operated to move the opening and closing drive unit upon being driven by the motor, and a blade wheel which is coupled to one of rotating shafts of the movable blades and is guided along the rail.

The opening and closing drive unit may include a belt carrier connecting the rotating shaft to the drive belt, and a carrier wheel rotatably coupled to the belt carrier.

The retractable sunshade apparatus further includes a carrier wheel guide which is supported by one of the pair of crosswise frames, extends in the longitudinal direction of the crosswise frame, and defines a space receiving the carrier wheel. The carrier wheel may be spaced apart from a bottom portion of the inner surface of the wheel guide positioned lower than the carrier wheel and may be in contact with an upper portion of the inner surface of the wheel guide positioned higher than the carrier wheel. The rail may be positioned higher than the upper portion of the inner surface.

The plurality of movable blades may be rotated by a predetermined angle while moving in the longitudinal direction of the crosswise frames.

The link may connect a first end of one of two adjacent movable blades to a second end of another of the two adjacent movable blades.

Advantageous Effects

First, the retractable sunshade apparatus according to the present invention has an effect of improving opening performance because the ceiling is opened by movement of the blades to one side.

Second, the retractable sunshade apparatus according to the present invention has an effect of improving convenience in use because opening and closing of the ceiling and degree of opening of the ceiling are controllable by means of an opening and closing drive unit.

Third, the retractable sunshade apparatus according to the present invention has an effect of providing an efficient and stable mechanism configured to open and close the ceiling because the blades, which are connected to each other via the link, are rotated and moved in linkage with each other while the opening and closing drive unit connected to one of the blades is moved by means of the drive belt.

Fourth, the retractable sunshade apparatus according to the present invention has an effect of enabling individual blades to be stably rotated and moved by coupling the blade wheel to the rotating shaft of the blade and providing the guide: frame with the rail configured to guide movement of the blade wheel.

Fifth, the retractable sunshade apparatus according to the present invention has an effect of further improving structural stability during rotation and movement of the blades by coupling the carrier wheel to the belt carrier connecting one of the blades to the drive belt and providing the guide frame with the carrier wheel guide configured to guide the carrier wheel.

Sixth, the retractable sunshade apparatus according to the present invention has an effect of preventing vertical shaking of the belt carrier and improving stable operation and structural stability because the carrier wheel guide restricts fine upward movement of the carrier wheel.

BEST MODE

Hereinafter, technical features and ideas described in embodiments of the present invention can be made independently or in combination. Although the present invention will be described with reference to the accompanying drawings and embodiments disclosed in detailed description of the present invention, these are only for illustrative purposes, and various modifications and other equivalent embodiments can be made by those skilled in the art to which the present invention belongs. Accordingly, the technical protection scope of the present invention should be decided by the appended claims.

Figure 1:
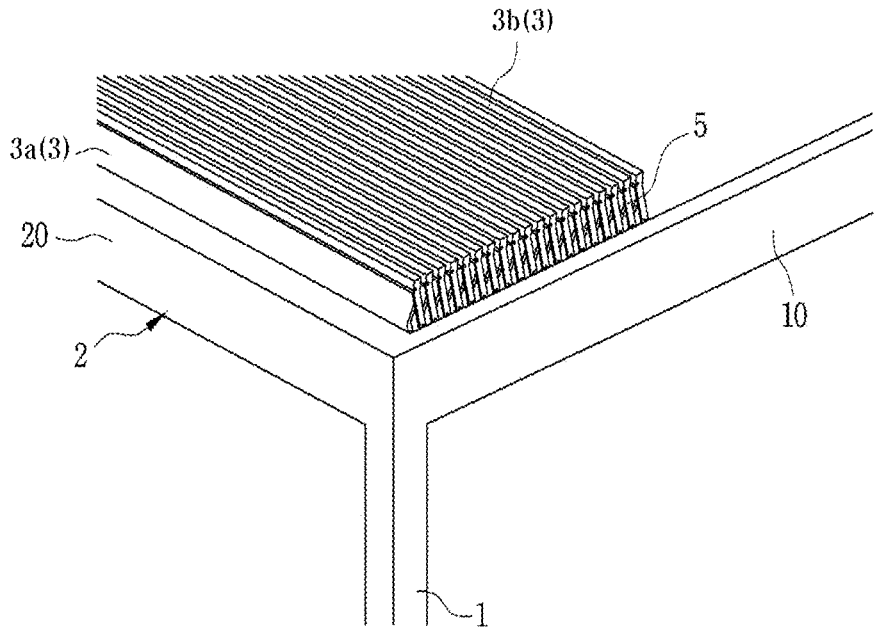
FIG. 1 is a view illustrating a retractable sunshade apparatus according to an embodiment of the present invention.
Figure 2:
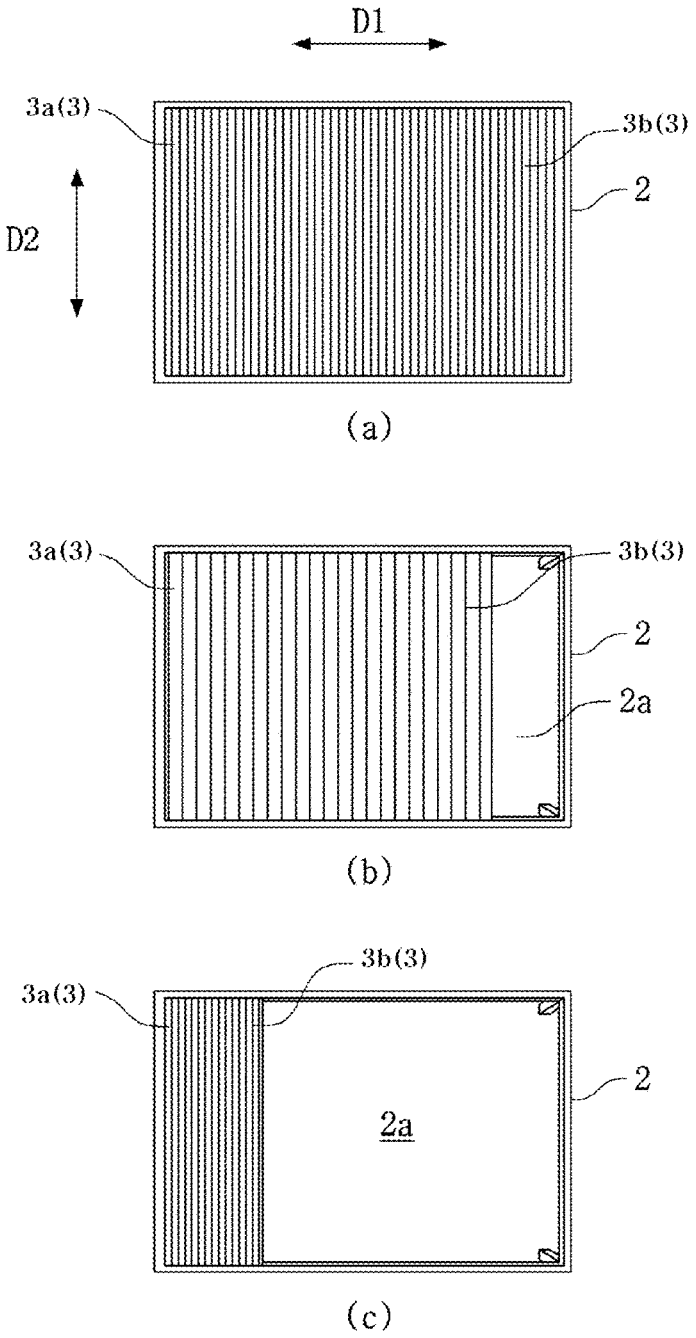
FIG. 2 is a view of the sunshade apparatus shown in FIG. 1 in which (a) illustrates a state in which a ceiling is fully closed, (b) illustrates a state in which the ceiling is partially opened, and (c) illustrates a state in which the ceiling is fully opened.
Figure 3:
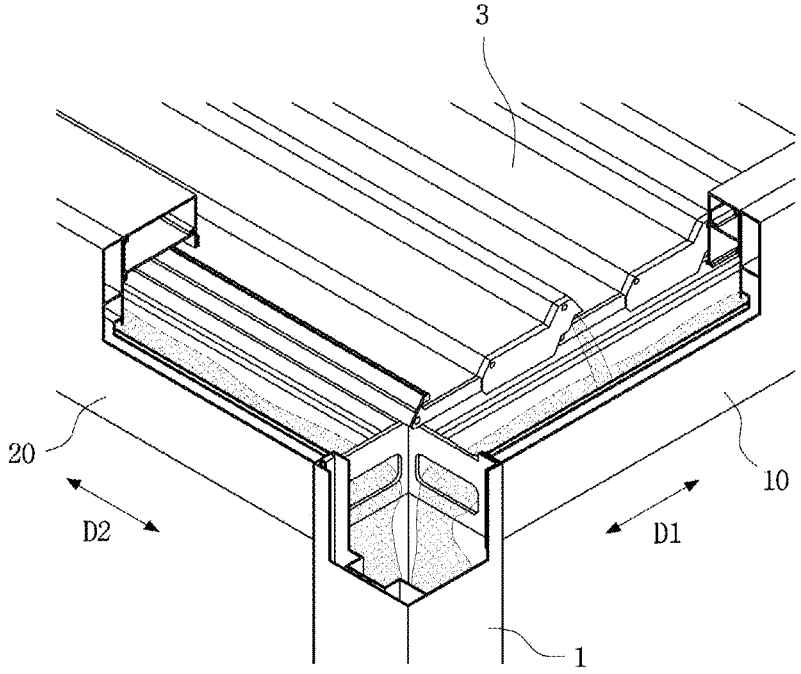
FIG. 3 is a partially broken-out view illustrating the sunshade apparatus shown in FIG. 1 in which the ceiling is fully closed.
Figure 4:
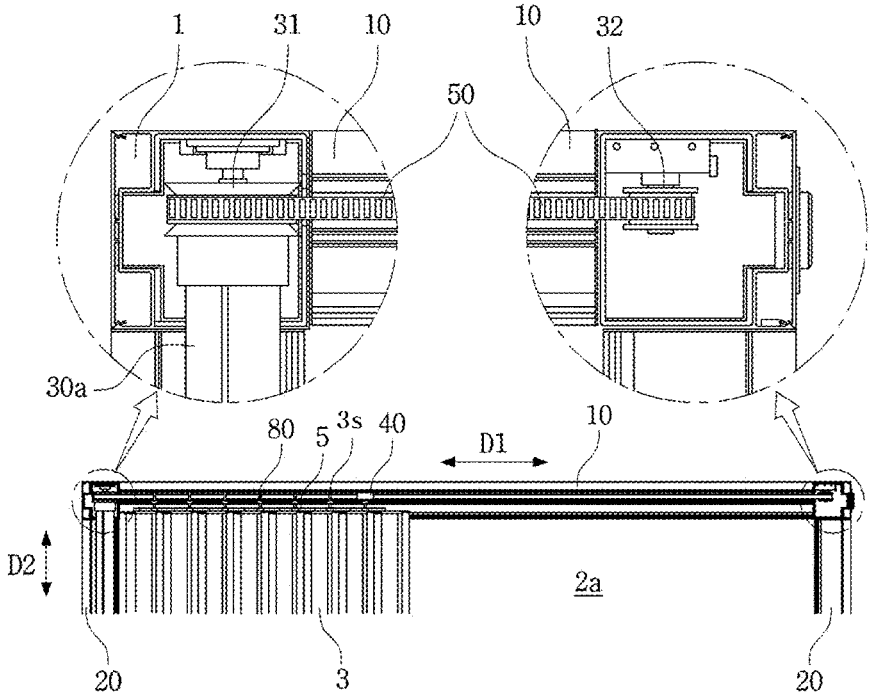
FIG. 4 is a plan view illustrating arrangement of a motor and a drive belt of the retractable sunshade apparatus shown in FIG. 1.
Figure 5:
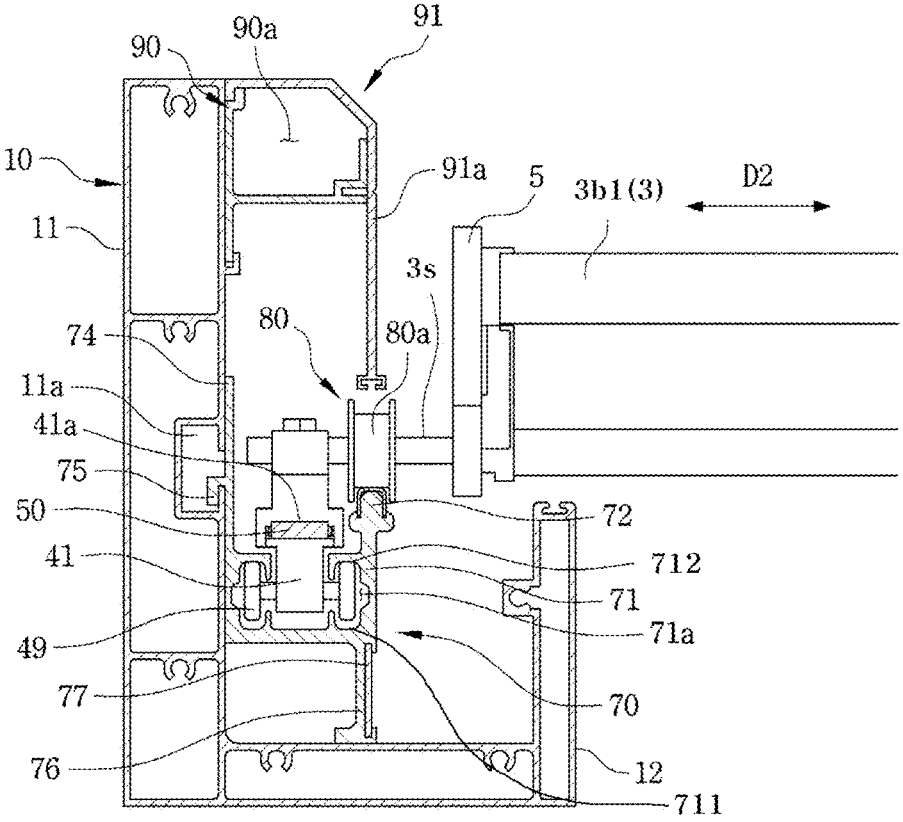
FIG. 5 is a view illustrating the longitudinal cross-section of a crosswise frame of the sunshade apparatus shown in FIG. 1.
Figure 6:
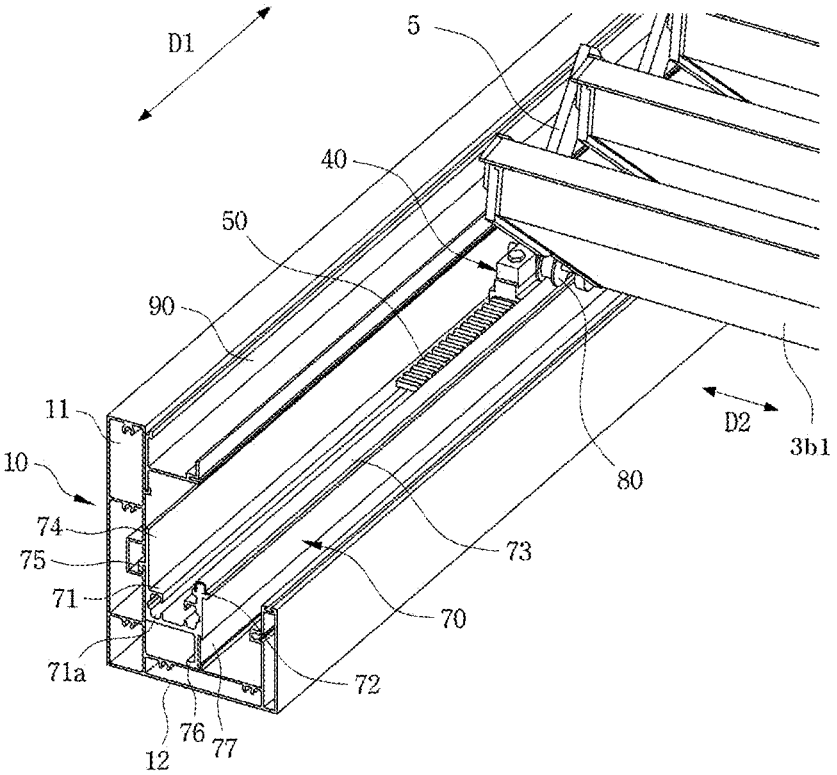
FIG. 6 is a perspective view illustrating the structure of a retractable drive unit.
Figure 7:
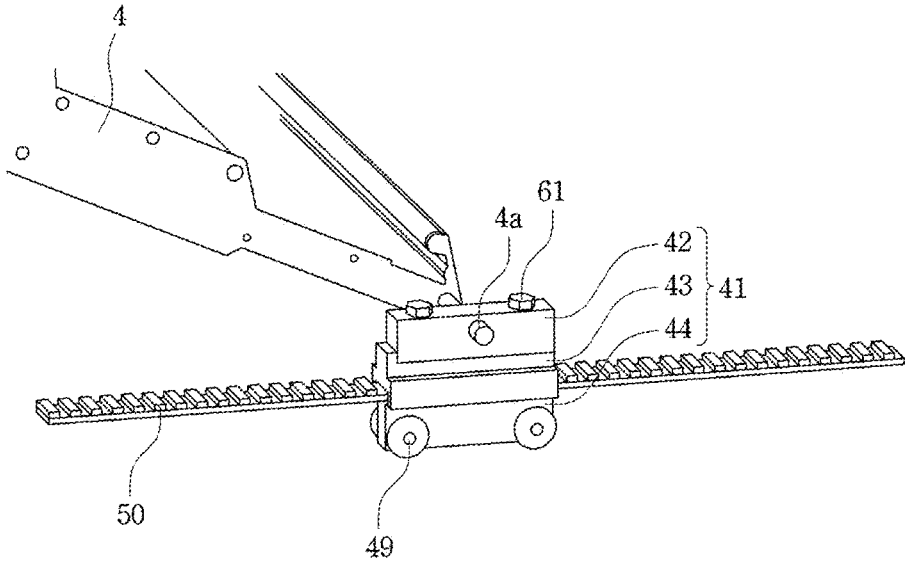
FIG. 7 is a view illustrating an assembly of a blade, a belt carrier and the drive belt.
Figure 8:
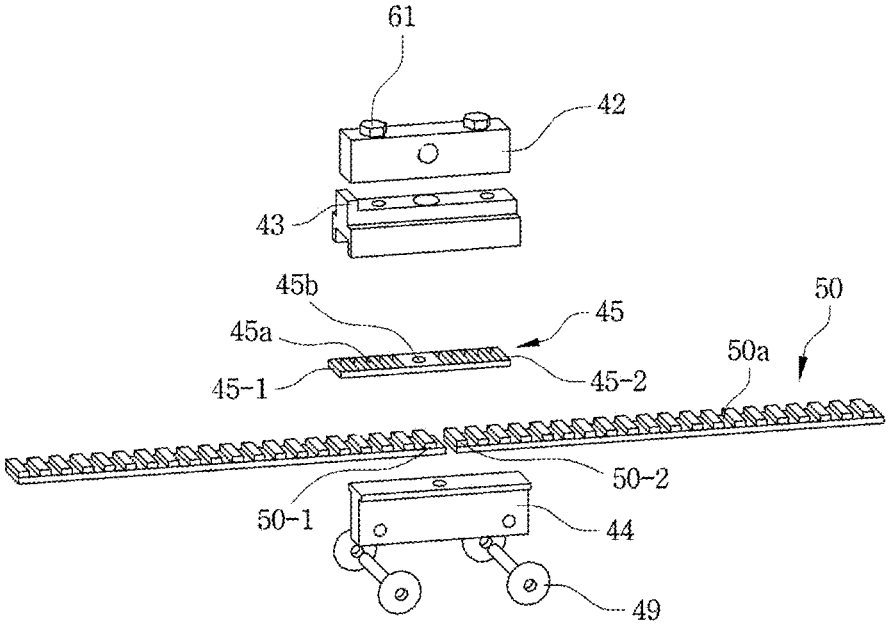
FIG. 8 is an exploded view of the belt carrier.

FIG. 1 is a view illustrating a retractable sunshade apparatus according to an embodiment of the present invention. FIG. 2 is a view of the sunshade apparatus shown in FIG. 1 in which (a) illustrates a state in which a ceiling is fully closed, (b) illustrates a state in which the ceiling is partially opened, and (c) illustrates a state in which the ceiling is fully opened. FIG. 3 is a partially broken-out view illustrating the sunshade apparatus shown in FIG. 1 in which the ceiling is fully closed. FIG. 4 is a plan view illustrating arrangement of a motor and a drive belt of the retractable sunshade apparatus shown in FIG. 1. FIG. 5 is a view illustrating the longitudinal cross-section of a crosswise frame of the sunshade apparatus shown in FIG. 1. FIG. 6 is a perspective view illustrating the structure of a retractable drive unit. FIG. 7 is a view illustrating an assembly of a blade, a belt carrier and the drive belt. FIG. 8 is an exploded view of the belt carrier.

Hereinafter, the retractable sunshade apparatus according to an embodiment of the present invention will be described with reference to FIGS. 1 to 8.

The retractable sunshade apparatus according to an embodiment of the present invention includes a roof frame 2 supported by at least one support post 1 and defining the ceiling 2*a*, and a plurality of blades 3 configured to open and close the ceiling 2*a*.

The roof frame 2 may include a pair of crosswise frames 10 and a pair of lengthwise frames 20. Here, the ceiling 2*a* is defined by the pair of crosswise frames 10 and the pair of lengthwise frames 20.

Each of the crosswise frames 10 may include a body portion 11 and a gutter portion 12. The body portion 11 may extend in a longitudinal direction of the crosswise frame 10 (referred to hereinafter as "crosswise direction D1"), and the gutter portion may extend parallel to the inner wall of the body portion 11. As illustrated in FIG. 5, the crosswise frame 10 may have an approximately L-shaped cross-section.

The plurality of blades 3 may extend in a longitudinal direction of the lengthwise frame 20 (referred to hereinafter as "lengthwise direction D2"), and may be arranged in the crosswise direction D1.

The plurality of blades 3 may be rotatably provided at the crosswise frame 10. At least some of the plurality of blades may be movable along the crosswise frame 10 in the crosswise direction D1. In other words, the plurality of blades may be operated in linkage with each other via a link mechanism so as to open or close the ceiling 2*a*.

The link mechanism may include a plurality of links 5. The plurality of links 5 may be constructed so as to cause the plurality of blades 3 to be rotated and moved in linkage with each other. (A pair of links 5 may connect two adjacent blades 3 at opposite sides.

Each of the links 5 may connect a pair of adjacent blades 3 to each other. One of the pair of blades 3 may be rotatably connected at a first end thereof to one end of the link 5, and the other of the blade 3 may be rotatably connected at a second end thereof to the other end of the link 5. The link mechanism is not limited thereto, and may be embodied in various known manners.

As the plurality of blades 3*b* are moved to one side in the crosswise direction D1 so as to open the ceiling 2*a*, the plurality of blades 3*b* are gradually oriented vertically through rotation thereof. Because all of the plurality of blades 3 are in the state of being oriented vertically when the plurality of blades 3 are maximally collapsed to one side, the area occupied by the blades 3 becomes the minimum and the ceiling 2*a* is maximally opened.

Meanwhile, as the plurality of blades 3*b* are moved to the opposite side in the crosswise direction D1 so as to close the ceiling, the individual blades 3 are gradually oriented horizontally through rotation thereof. Because all of the blades 3 are oriented horizontally when the plurality of blades 3 are maximally expanded to the opposite side, the blades 3 close the entire ceiling 2*a*.

In this way, the rate of opening of the ceiling 2*a* is controlled according to moving distance of the blades 3*b* in the crosswise direction D1, and sunshading is thus controlled according to the extent to which the blades 3 are oriented vertically.

Although the plurality of blades 3 can be expanded in the crosswise direction (in the direction of arrow D1) so as to shield the entire ceiling 2*a*, the present invention is not necessarily limited thereto. Alternatively, the plurality of blades 3 may also be expanded in the crosswise direction (in the direction of arrow D1) so as to shield only a portion of the ceiling 2*a*.

Each of the blades 3 may be provided with rotating shafts 3*s* at both sides thereof in the lengthwise direction (in the direction of arrow D2) such that the blade 3 is oriented vertically or horizontally according to the rotation of the rotating shafts.

At least one 3*a* of the plurality of blades 3 may be a positionally-fixed blade (referred to hereinafter as "fixed blade"), and the remaining ones 3*b* of the plurality of blades 3 may be movable blades capable of moving in the crosswise direction D1. Among the plurality of blades 3, one blade 3*a*, which is disposed at the outermost position, may be the fixed blade, and the remaining blades may be movable blades.

The rotating shaft 3*s* of each of the movable blades 3*b* may be coupled to a blade wheel 80 which is rollable along a rail 72 to be described later. The rail 72 may be provided at each of two guide frames 70 (see FIG. 5).

Each of the movable blades 3*b* may be provided at opposite sides thereof with a pair of rotating shafts 3*s* which are coaxially aligned with each other and are rotatably connected to the two opposite crosswise frames 10. Each of the rotating shafts 3*s* may be coupled to the blade wheel 80.

The fixed blade 3*a* may be rotatably connected at the first end thereof to the crosswise frame 10 in place and may be connected at the second end thereof to the first end of an adjacent movable blade 3*b* via the link 5.

The sunshade apparatus according to an embodiment of the present invention may further include an opening and closing drive unit 40 connected to at least one 3*b*1 of the plurality of movable blades 3*b* and configured to be movable in the longitudinal direction of the crosswise frame 10, a motor 30 configured to supply rotative force, and a drive belt 50 which is driven by the motor 30 to move the opening and closing drive unit 40.

The opening and closing drive unit 40 and the drive belt 50 may be installed to each of the pair of crosswise frames 10 so as to stably move and rotate the plurality of movable blades 4 at opposite sides.

The motor 30 may be disposed on the lengthwise frame 20. A drive pulley 31 may be positioned at one side of the crosswise frame 10 in the crosswise direction D1, and an idle wheel 32 may be positioned at the other side of the crosswise frame 10 which is spaced apart from the drive pulley 31 in the crosswise direction D1. The drive belt 50 may be wound around the drive pulley 31 and the idle wheel 32.

FIGS. 6 to 8 illustrate only a portion of the drive belt 50. In fact, the drive belt 50 may be wound around at least the drive pulley 31 and the idle wheel 32, and may preferably define an annular ring.

The opening and closing drive unit 40 may include a belt carrier 41 connecting the rotating shaft 3*s* of the movable blade 3*b* to the drive belt 50, and a carrier wheel 49 rotatably coupled to the belt carrier 41.

The belt carrier 41 may include a first carrier member 42, a second carrier member 43 and a third carrier member 44.

The first carrier member 42 may be rotatably connected to the rotating shaft 3*s* of the movable blade 3*b*. The second carrier member 43 may be coupled to the lower side of the first carrier member 42 and may define a belt-receiving portion 41*a* (see FIG. 5). The belt-receiving portion 41*a* may be a groove formed in the bottom surface of the second carrier member 43. The groove may be open at opposite sides so as to allow the two ends of the drive belt 50 to be inserted thereinto in the crosswise direction D1.

Because the plural carrier members 42, 43 and 44 are assembled with one another to constitute a single unit, there is an advantage of easy installation, removal or maintenance of the drive belt 50.

The first to third carrier members 42, 43 and 44 may be coupled to one another via bolts, screws or the like. The first carrier member 42 and the second carrier member 43 may be coupled to each other via a first fastening element 61, and the second carrier member 43 and the third carrier member 44 may be coupled to each other via a second fastening element (not shown).

The belt carrier 41 may further include a belt connector 45 which is disposed in the belt-receiving portion 41*a* and at which a plurality of first teeth 45*a* are arranged in the longitudinal direction. The first teeth 45*a* may be formed on the upper surface and/or the lower surface of the belt connector 45.

The drive belt 50 may be provided with second teeth 50*a* which are engaged with the first teeth 45*a*. The second teeth 50*a* may be formed on one surface and/or the other surface of the drive belt 50.

The belt connector 45 may have a first fastening hole 45*b* which is formed at an approximately center thereof and through which the second fastening element extends in an up-and-down direction. First and second teeth portions 45-1 and 45-2, each of which includes a plurality of first teeth 45*a*, may be provided at both sides of the first fastening hole 45*b*.

The drive belt 50 may have the shape of a single strip two ends of which are free ends. The two ends 504- and 50-2 of the drive belt 50 may be connected to each other via the belt connector 45.

At least one carrier wheel 49 may be coupled to the third carrier member 440. As illustrated in FIG. 8, two pairs of carrier wheels 49 may be provided such that the belt carrier 41 can move stably.

The crosswise frame 10 may be provided with a guide frame 70. The guide frame 70 may be coupled to the inner wall of the crosswise frame 10. The guide frame 70 may include a carrier wheel guide 71 defining wheel-receiving spaces 71*a* each of which is open at the upper surface thereof.

The carrier wheel guide 71 may include a pair of wheel-receiving spaces 71*a* each of which receives a corresponding one of the carrier wheels 49.

Each of the wheel-receiving spaces 71*a* may be open at the upper surface thereof so as to allow the lower end of the belt carrier 41 to pass therethrough, and may extend in the longitudinal direction D1 of the crosswise frame 10 so as to allow the carrier wheel 49 to move in the crosswise direction D1. The wheel-receiving spaces 71*a* may be positioned below the rail 72.

Each of the carrier wheels 49 may roll along the inner surface of the carrier wheel guide 71 defining the wheel-receiving space 71*a*. When the blade wheel 80 is in contact with the rail 72, the carrier wheel 49 may be spaced apart from the bottom 711 of the inner surface of the carrier wheel guide 71 which is positioned lower than the carrier wheel 49. In this state, the carrier wheel 49 may be maintained in the t state of being in contact with the top surface 712 of the inner surface of the carrier wheel guide 71 which is positioned higher than the carrier wheel 49.

Because downward shaking of the belt carrier 41 is prevented by the rail 72 supporting the blade wheel 80 at a lower side and upward shaking of the belt carrier 41 is prevented by the top surface 712 contacting the carrier wheel 49 at an upper side while the belt carrier 41 is moving, the belt carrier 41 can stably move without shaking, thereby offering an effect of reducing noise and assuring durability.

The carrier wheel guide 71 may have an approximately C-shaped cross-section. The rotating shaft 3*s* of the movable blade 3*b* may pass through the open portion of the C-shaped cross-section.

A bearing or the like may be disposed between the blade wheel 80 and the rotating shaft 3*a* such that the blade wheel 80 can move in the crosswise direction (in the direction of arrow D1) together with the movable blade 4 while only the blade wheel 80 is rotated relative to the movable blade 4.

The blade wheel 80 may be provided with an annular rail groove 80*a* which is open in a radial direction and extends in a circumferential direction of the blade wheel 800 and in which the rail 72 is received, thereby enabling the blade wheel 80 to move along the rail 72 without shaking.

Although the blade wheel 80 may be in direct contact with the rail 72, the rail 71 may be surrounded by a rail cover 73 having an approximately C-shaped cross-section and the rail cover 73 may be in contact with the blade wheel 80, as in this embodiment. In the case in which an additional rail cover 73 is provided, it is easy to form the portion that contacts the blade wheel 80, thereby advantageously assuring flatness and straightness of the portion.

The guide frame 70 may be removably coupled to the crosswise frame 10. The guide frame 70 may include a panel portion 74 which extends upwards from the carrier wheel guide 71 and is in surface contact with the inner wall of the body portion 11 of the crosswise frame 10, and a catch protrusion 75 projecting toward the body portion 11 of the crosswise frame 10 from the panel portion 74. The catch protrusion 75 may be formed to have an "L" shape. The inner wall of the body portion 11 of the crosswise frame 10 may be provided therethrough with a coupling hole 11*a* through which the catch protrusion 75 extends in the lengthwise direction D2.

The guide frame 70 may further include a support 76 which extends downwards from the carrier wheel guide 71 and is disposed in the gutter 12 of the crosswise frame 10. The support 76 may be provided with a trash rack 77 configured to block introduction of contaminants.

The sunshade apparatus according to an embodiment of the present invention may further include a cable frame 90 which is coupled to the inner wall of the crosswise frame 10 above the belt carrier 41 and defines a cable space 90*a* in which a cable is disposed.

The cable frame 90 may be formed so as to be open at the upper side thereof, and the open side of the cable frame 90 may be covered by a cover panel 91.

The cover panel 91 may further include an extension 91*a* which extends to the upper side of the blade wheel 80 from the lower side of the cable frame 90 to shield the space defined by the cable frame 90 and the belt carrier 41.

Figure 9:
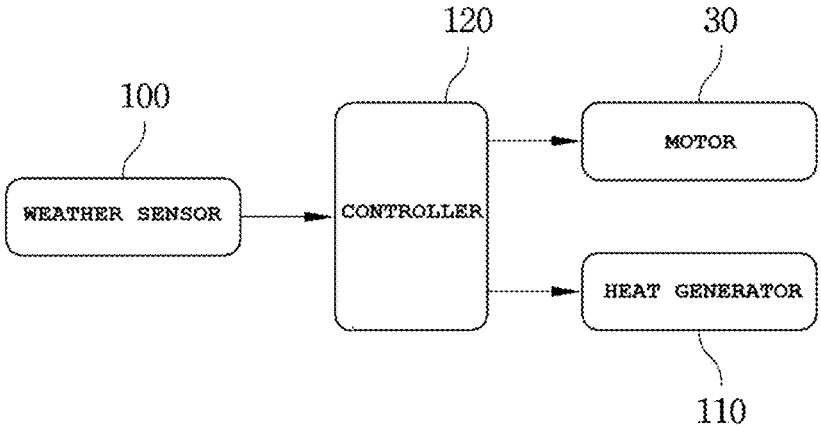
FIG. 9 is a block diagram illustrating control relationships between main components of the sunshade apparatus according to an embodiment of the present invention.

FIG. 9 is a block diagram illustrating control relationships between main components of the sunshade apparatus according to an embodiment of the present invention.

Referring to FIG. 9, the sunshade apparatus according to an embodiment of the present invention may include a weather sensor 100 configured to detect rainfall and/or snowfall, a heat generator 110 disposed on the movable blade 3*b*, and a controller 120 configured to control at least one of the motor 30 and the heat generator 110 according to the result of detection from the weather sensor 100. The heat generator 110 may also be disposed on the fixed blade 3.

When the ceiling 2*a* is in the open state upon detecting rainfall or snowfall by the weather sensor 100, the controller 120 may control the motor 30 to close the ceiling 2*a*.

Furthermore, if the ceiling 2*a* is opened while rainwater or snow remains on the blade 3 after stopping of rainfall or snowfall, there may be a problem in that the rainwater or the snow falls from the blade 3. In order to solve the above problem, the controller 120 may activate the heat generator 110 in a predetermined pattern or at a predetermined frequency to quickly remove the moisture on the blade 3.

Meanwhile, when the weather sensor 100 detects snowfall, the controller 120 may perform control to activate the heat generator 110 to melt the snow on the blade 3 while snow is falling. Therefore, because the additional load caused by snow accumulation is removed, there is an effect of preventing damage to the blade 3.

The heat generator 110 may be embodied as a heating wire sheet which is disposed on the surface of the blade 3 and on which a heating wire of a predetermined pattern is printed so as to generate heat by current. However, the present invention is not necessarily limited thereto.

Furthermore, the sunshade apparatus may also be constructed so as to increase the temperature of the rest space under the sunshade apparatus using the heat generated by the heat generator 110. For example, the controller 120 may control the heat generator 110 to heat the rest space even when the weather sensor 100 does not detect rainfall or snowfall. In some embodiments, the sunshade apparatus may further include a temperature sensor (not shown) configured to detect temperature of the rest space. In this case, the controller 120 may control activation of the heat generator 100 according to the value detected by the temperature sensor.

In some embodiments, the sunshade apparatus according to the present invention may further include an input unit (not shown) to which a drive command for activating the heat generator 110 is input. The controller 120 may perform to activate the heat generator 110 depending on a drive command input to the input unit 130.

Meanwhile, when the ceiling 2*a* is in the open state upon inputting a drive command through the input unit 130, the controller 120 may control activation of the motor 30 to close the ceiling 2*a*.

The invention claimed is:

1. A retractable sunshade apparatus comprising:

a roof frame comprising a pair of crosswise frames and a pair of lengthwise frames which define an open ceiling;

a plurality of movable blades which are rotatable relative to the crosswise frames, are movable in a longitudinal direction of the pair of crosswise frames, and are interconnected so as to be moved in linkage via a link;

an opening drive unit connected to at least one of the plurality of movable blades and movable in the longitudinal direction of the crosswise frames;

a motor configured to supply rotative force;

a drive belt which is operated to move the opening drive unit by the motor;

a blade wheel coupled to one of rotating shafts of the movable blades;

a guide frame provided at at least one of the crosswise frames under the blade wheel to form a rail configured to guide movement of the blade wheel; and a rail cover surrounding an upper end of the rail and having a C-shaped cross-section, wherein the opening drive unit comprises:

a belt carrier connecting the one of the rotating shafts of the movable blades to the drive belt; and a carrier wheel rotatably coupled to the belt carrier under the blade wheel and disposed on the guide frame so as to be movable while rotating about a predetermined axis parallel to the one of the rotating shafts of the movable blades, wherein the belt carrier comprises a belt-receiving portion and a belt connector disposed in the belt-receiving portion, the belt connector comprising a plurality of first teeth arranged in a longitudinal direction of the belt connector, wherein the drive belt has a shape of a single strip having two ends, the drive belt comprises second teeth that are engaged with the first teeth, and the two ends of the drive belt are connected to each other via the belt connector, wherein the guide frame comprises a carrier wheel guide, which is provided under the rail to define a space receiving the carrier wheel and an inner surface of which, defining the space, guides movement of the carrier wheel, wherein the carrier wheel guide is constructed such that a portion of the inner surface, which defines the space and is positioned above the carrier wheel, is maintained in a state of being in contact with the carrier wheel during movement of the carrier wheel, and wherein the blade wheel comprises an annular rail groove which is open in a radial direction and extends in a circumferential direction of the blade wheel, the rail being received in the annular rail groove, and the blade wheel being in contact with the rail cover.

2. The retractable sunshade apparatus according to claim 1, further comprising:

a weather sensor configured to detect rainfall or snowfall;

a heat generator disposed on the movable blades; and a controller configured to control activation of the motor and the heat generator according to a result of detection by the weather sensor, wherein, when the weather sensor detects the rainfall or the snowfall while the open ceiling is in an open state, the controller is configured to activate the motor to close the open ceiling, and wherein, when the weather sensor detects the snowfall, the controller is configured to activate the heat generator to melt the snowfall on the movable blades.

* * * * *